US005259439A

United States Patent [19]

Blejde et al.

[11] Patent Number: 5,259,439

[45] Date of Patent: * Nov. 9, 1993

[54] STRIP CASTING

[75] Inventors: Walter Blejde, Balgowie; William J. Folder; Hisahiko Fukase, both of Wollongong; William J. Sinclair, Carnegie, all of Australia

[73] Assignees: Ishikawajima-Harima Heavy Industries Company Limited, Tokyo, Japan; John Lysaght, Sydney, Australia

[ * ] Notice: The portion of the term of this patent subsequent to Feb. 9, 2010 has been disclaimed.

[21] Appl. No.: 892,492

[22] Filed: Jun. 3, 1992

Related U.S. Application Data

[63] Continuation of Ser. No. 679,663, Apr. 1, 1991, abandoned.

[30] Foreign Application Priority Data

Apr. 4, 1990 [AU] Australia ..... PJ9459
Jul. 13, 1990 [AU] Australia ..... PK1161

[51] Int. Cl.[5] ..... B22D 11/06

[52] U.S. Cl. ..... 164/121; 164/480; 272/593

[58] Field of Search ..... 164/428, 480, 121, 437; 222/493

[56] References Cited

FOREIGN PATENT DOCUMENTS

| | | | |
|---|---|---|---|
| 269803 | 7/1989 | German Democratic Rep. | 222/593 |
| 57-3764 | 1/1982 | Japan | 164/437 |
| 61-176447 | 6/1986 | Japan | 164/480 |
| 63-132755 | 6/1988 | Japan | 164/437 |

*Primary Examiner*—Kuang Y. Lin
*Attorney, Agent, or Firm*—Nikaido, Marmelstein, Murray & Oram

[57] ABSTRACT

Method and apparatus for casting metal strip in which molten metal is introduced between a pair of parallel casting rollers (16) via a tundish (18) and delivery nozzle (19). Casting rollers (16) are cooled so that shells solidify on the moving roller surfaces and are brought together at the nip between them to produce a solidified strip product (20) at the roller outlet. The tundish (18), delivery nozzle (19) and a pair of side closure plates (56) to confine the pool of metal on the casting rollers are separately preheated to working temperature and then rapidly brought into an operative assembly and casting is started before detrimental uneven or localized cooling of the preheated components can develop. To avoid material deterioration and metal flow irregularities due to oxidation on preheating, the delivery nozzle (19) and side closure plates (56) are provided with oxidation retarding coatings, for example in the form of ceramic glazing, or are preheated in an inert atmosphere.

9 Claims, 9 Drawing Sheets

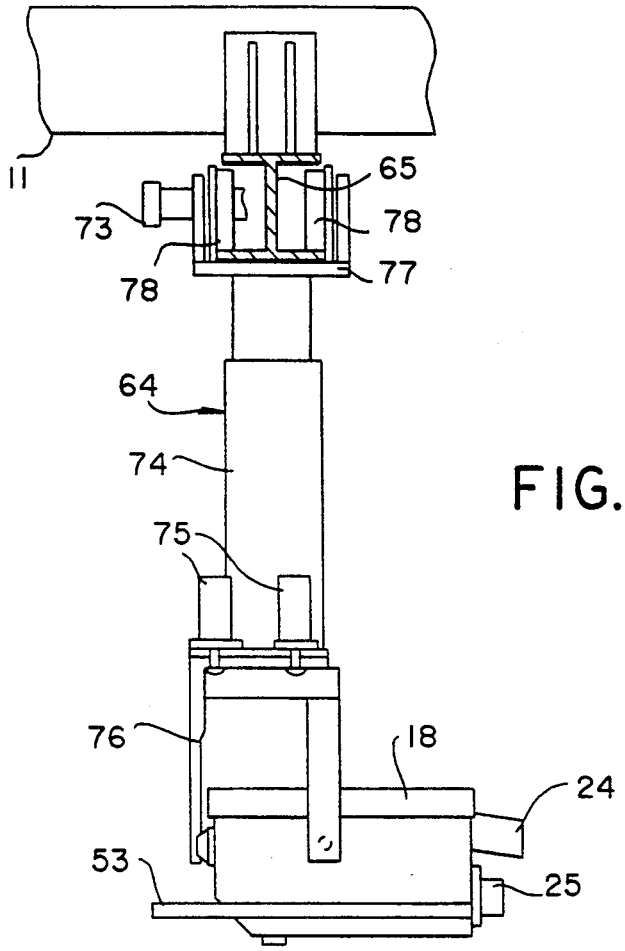
FIG.4
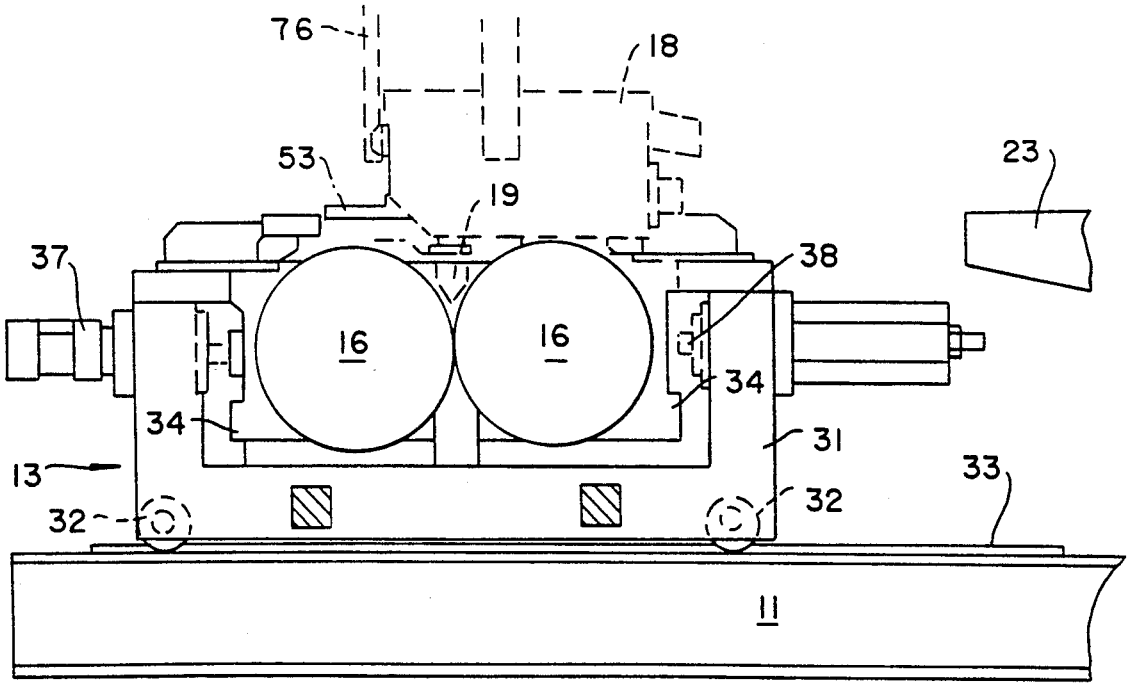

STRIP CASTING

This application is a continuation of application Ser. No. 679,663 filed Apr. 4, 1991, now abandoned.

TECHNICAL FIELD

This invention relates to casting of metal strip.

The invention has particular application to twin roll casting in which molten metal is introduced into the nip between a pair of cooled casting rollers which are contra-rotated so that metal shells solidify on the moving roller surfaces and are brought together at the nip between them to produce a solidified strip product at the roller outlet.

The molten metal may be introduced into the nip between the rollers by a refractory metal delivery nozzle to form a pool of molten metal at the nip and the pool may be confined at the two ends of the nip by a pair of end closure refractory plates which engage the casting rollers. In this case the delivery nozzle and the side closure plates must be made of refractory material capable of withstanding high temperatures well in excess of 1000° C. and they must be preheated to temperatures of this order prior to a casting operation. One such refractory material is alumina graphite. However, it has been found that the use of alumina graphite is not entirely satisfactory in that the graphite oxidizes during the preheating step to cause degradation of the alumina graphite components. Such degradation of the side plates can seriously diminish the mechanical strength and abrasion resistance of those plates. In the case of the metal delivery nozzle degradation of the critical flow guiding surfaces in the vicinity of the nozzle outlet can lead to flow irregularities and defects in the resultant strip product.

The problem of oxidation during preheating can be overcome to some extent by use of more expensive refractory material such as boron nitride. The present invention provides a less expensive solution whereby it is possible to use normal refractory material such as alumina graphite.

DISCLOSURE OF THE INVENTION

According to the invention there is provided a method of casting metal strip wherein molten metal is introduced between a pair of parallel casting rollers by means including a flow confining refractory member, wherein at the commencement of a casting operation said refractory member is preheated and wherein said refractory member is provided with an oxidation retarding coating to retard oxidation during preheating or is preheated in an inert atmosphere.

The invention also provides for use with a pair of casting rollers for continuous casting of metal strip, a metal flow confining refractory member to confine the flow of metal to the casting rollers, said refractory member being provided with a surface coating capable of retarding oxidation of underlying material to elevated temperatures of at least 1000° C.

The refractory member may be a plate positioned at any end of the pair of parallel casting rollers during casting to confine a pool of casting metal. Accordingly, the invention specifically provides a method of casting metal strip wherein molten metal is introduced between a pair of parallel casting rollers to form a casting pool between a pair of end plates disposed one at each end of the nip between the casting rollers, wherein at the commencement of a casting operation the end plates are preheated at locations spaced from the rollers and are then brought into their operative positions at the ends of the rollers, and wherein said end plates each have an oxidation retarding coating to retard oxidation during preheating or are preheated in an inert atmosphere.

The refractory member may be a metal delivery nozzle. Accordingly the invention also specifically provides a method of casting metal strip wherein molten metal is introduced between a pair of parallel casting rollers by a refractory delivery nozzle wherein at the commencement of a casting operation the delivery nozzle is preheated, and wherein the delivery nozzle has an oxidation retarding coating to retard oxidation during preheating or is preheated in an inert atmosphere.

The refractory member may be comprised of alumina graphite. In the case where the refractory member is provided with an oxidation retarding coating, the coating may be a silicon based ceramic glaze capable of protecting against oxidation to temperatures in excess of 1200° C. Preferably, the glaze is capable of protecting against oxidation up to about 1500° C., which may be encountered at least in localized areas during preheating, particularly if a gas furnace is used for the preheating step.

The glaze can be applied to the refractory member by means of an applicator roller having circumferential grooves which provide for a flow of coating onto the plate surface to a controlled thickness. Such applicators are used in the production of coated steel products for painting with various coatings. The glaze can be abraded from the coated refractory member or otherwise consumed during casting so as to serve as a sacrificial coating. Once casting has commenced, the abraded surfaces will remain covered with molten metal and oxidation is no longer a problem.

In the case where the refractory member is preheated in an inert atmosphere it may be introduced into an enclosed furnace into which an inert gas can be pumped so as to allow the refractory member to be preheated in the inert atmosphere. Preferably, the furnace is an electric resistance furnace into which argon can be pumped to produce an argon blanket.

BRIEF DESCRIPTION OF THE DRAWINGS

In order that the invention may be more fully explained, its application to one particular kind of caster will now be described in some detail with reference to the accompanying drawings in which:

in FIG. 1;

FIG. 4 is a partly sectioned elevation of a part of the caster which particularly illustrates a tundish lifting apparatus incorporated in the caster;

BEST MODE OF CARRYING OUT THE INVENTION

Figure 1:
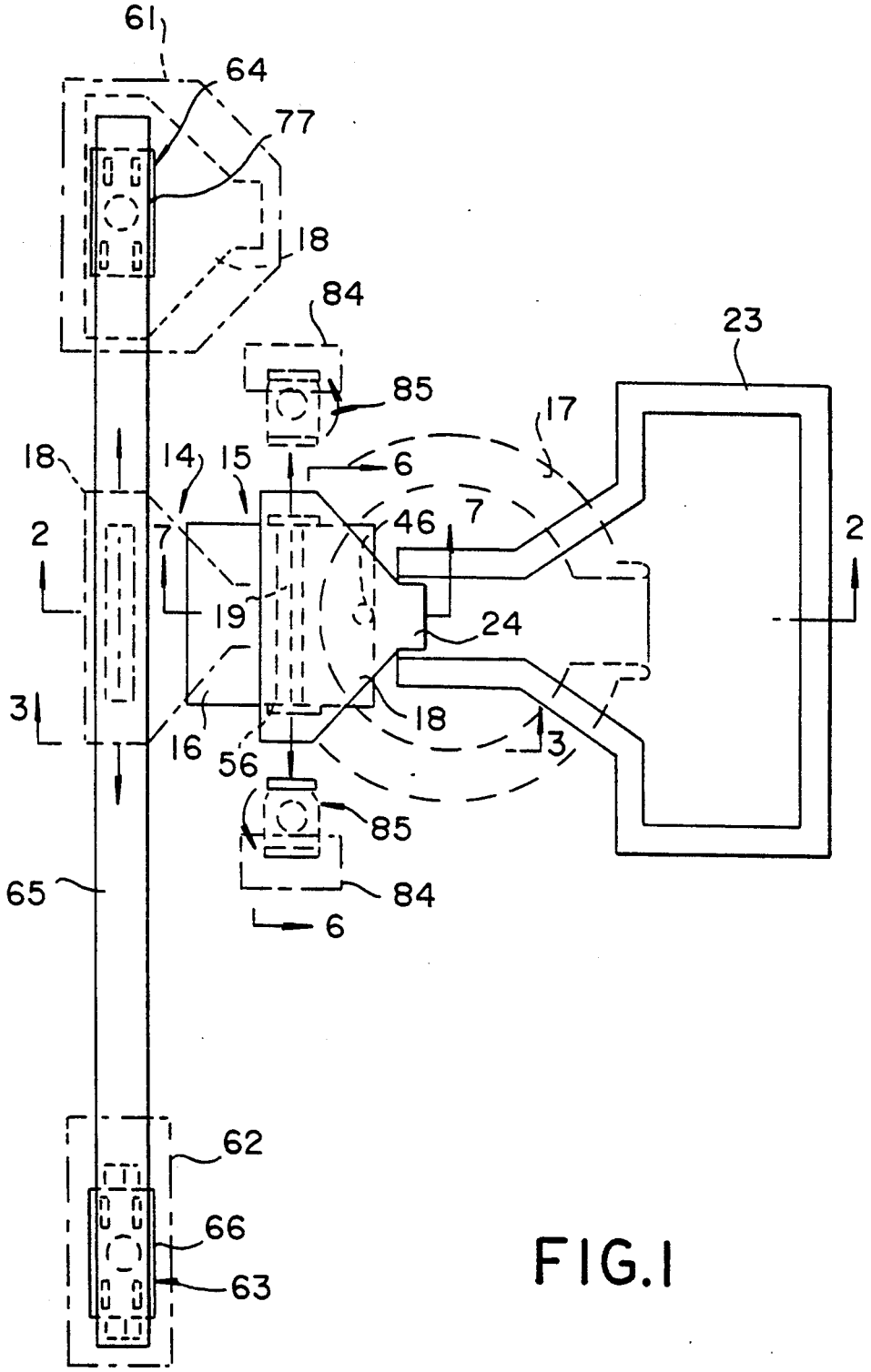
FIG. 1 is plan view of a continuous strip caster including a casting roller carriage movable between an assembly station and a casting station.

The illustrated caster comprises a main machine frame 11 which stands up from the factory floor 12. Frame 11 supports a casting roller carriage 13 which is horizontally movable between an assembly station 14 and a casting station 15. Carriage 13 carries a pair of parallel casting rollers 16 to which molten metal is supplied during a casting operation from a ladle 17 via a tundish 18 and delivery nozzle 19. Casting rollers 16 are water cooled so that shells solidify on the moving roller surfaces and are brought together at the nip between them to produce a solidified strip product 20 at the roller outlet. This product is fed to a standard coiler 21 and may subsequently be transferred to a second coiler 22. A receptacle 23 is mounted on the machine frame adjacent the casting station and molten metal can be diverted into this receptacle via an overflow spout 24 on the tundish or by withdrawal of an emergency plug 25 at one side of the tundish if there is a severe malformation of product or other severe malfunction during a casting operation.

Roller carriage 13 comprises a carriage frame 31 mounted by wheels 32 on rails 33 extending along part of the main machine frame 11 whereby roller carriage 13 as a whole is mounted for movement along the rails 33. Carriage frame 31 carries a pair of roller cradles 34 in which the rollers 16 are rotatably mounted. Roller cradles 34 are mounted on the carriage frame 31 by interengaging complementary slide members 35, 36 to allow the cradles to be moved on the carriage under the influence of hydraulic cylinder units 37, 38 to adjust the nip between the casting rollers 16. The carriage is movable as a whole along the rails 33 by actuation of a double acting hydraulic piston and cylinder unit 39, connected between a drive bracket 40 on the roller carriage and the main machine frame so as to be actuable to move the roller carriage between the assembly station 14 and casting station 15 and visa versa.

Casting rollers 16 are contra rotated through drive shafts 41 from an electric motor and transmission mounted on carriage frame 31. Rollers 16 have copper peripheral walls formed with a series of longitudinally extending and circumferentially spaced water cooling passages supplied with cooling water through the roller ends from water supply ducts in the roller drive shafts 41 which are connected to water supply hoses 42 through rotary glands 43. The rollers may typically be about 500 mm diameter and up to 1300 mm long in order to product 1300 mm wide strip product.

Figure 2:
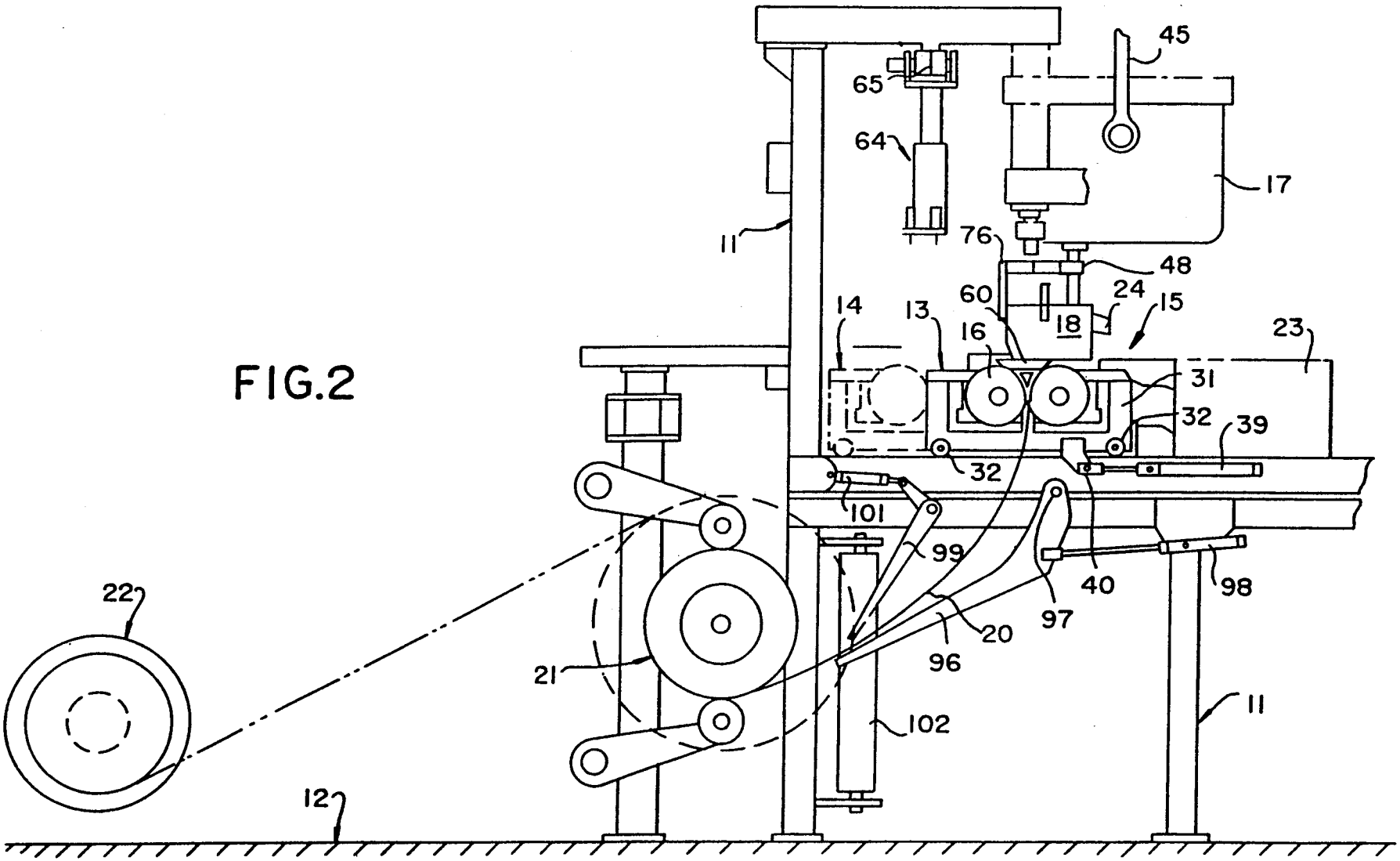
Figure 7:
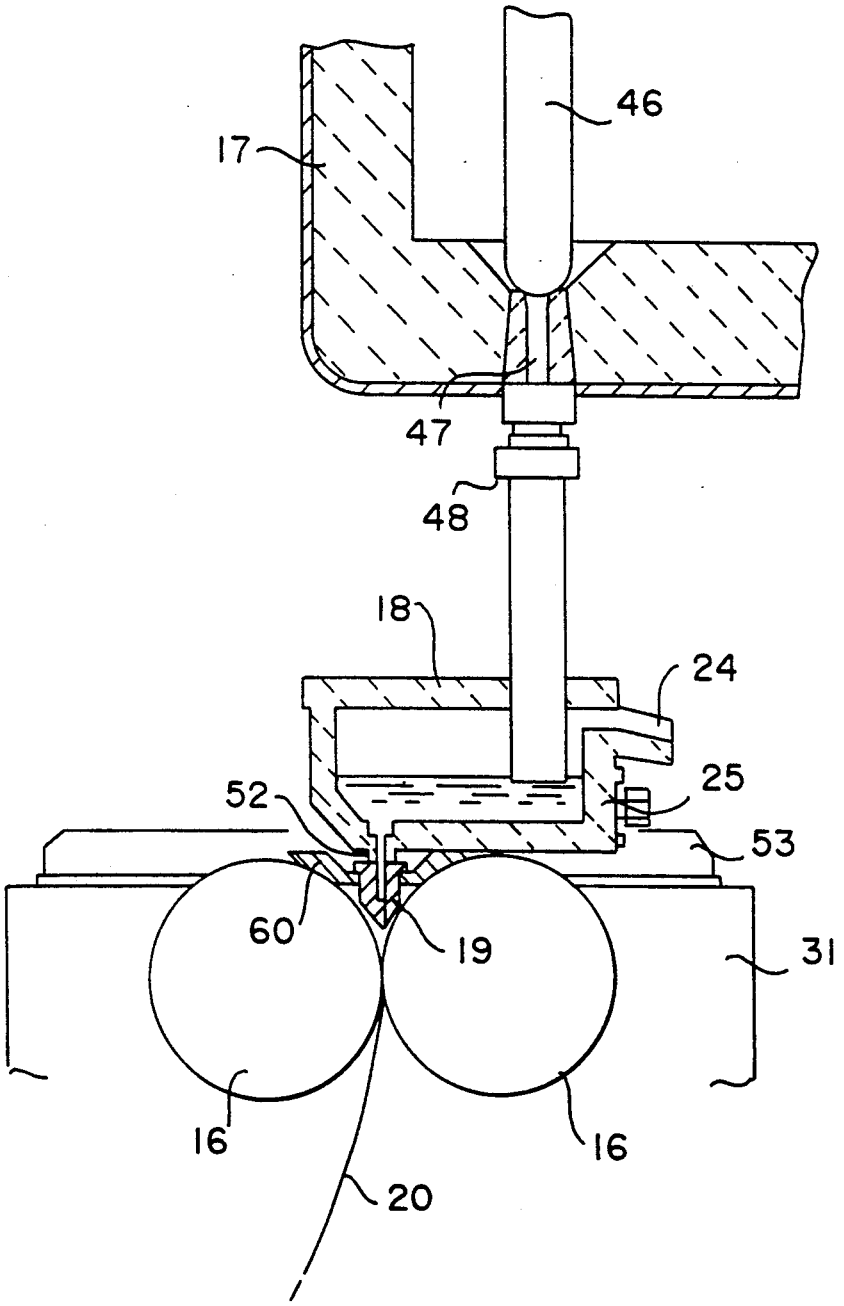
FIG. 7 is a vertical cross-section on the line 7—7 in FIG. 1.

The arrangement of the ladle, tundish and delivery nozzle during a casting operation is most clearly seen in FIGS. 1, 2 and 7. Ladle 17 is of entirely conventional construction and is supported via a yoke 45 on an overhead crane whence it can be brought into position from a hot metal receiving station. The ladle is fitted with a stopper rod 46 actuable by a servo cylinder to allow molten metal to flow from the ladle through an outlet nozzle 47 and refractory shroud 48 into tundish 18.

Tundish 18 is also of conventional construction. It is formed as a wide dish made of a refractory material such as alumina graphite. One side of the tundish receives molten metal from the ladle and is provided with the aforesaid overflow 24 and emergency plug 25. The other side of the tundish is provided with a series of longitudinally spaced metal outlet openings 52. The lower part of the tundish carries mounting brackets 53 for mounting the tundish onto the roller carriage frame 31 and provided with apertures to receive indexing pegs 54 on the carriage frame so as accurately to locate the tundish as will be more fully described below.

Delivery nozzle 19 is formed as an elongate body made of a refractory material such as alumina graphite. Its lower part is tapered so as to converge inwardly and downwardly so that it can project into the nip between casting rollers 16. It is provided with a mounting bracket 60 whereby to support it on the roller carriage frame and its upper part is formed with outwardly projecting and downwardly facing side shoulders 55 whereby it can be picked up and transported by a robot mechanism as described below.

Nozzle 19 may have a series of horizontally spaced generally vertically extending flow passages to produce a suitably low velocity discharge of metal throughout the width of the rollers and to deliver the molten metal into the nip between the rollers without direct impingement on the roller surfaces at which initial solidification occurs. Alternatively, the nozzle may have a single continuous slot outlet to deliver a low velocity curtain of molten metal directly into the nip between the rollers. The nozzle outlet may be above the meniscus level of the molten metal pool which forms above the nip between the rollers or it may be immersed in the molten metal pool. As will be more fully explained below, the pool is confined at the ends of the rollers by a pair of side closure plates 56 which are held against stepped ends 57 of the rollers when the roller carriage is at the casting station.

Prior to a casting operation ladle 17, tundish 18, metal delivery nozzle 19 and the side closure plates 56 must all be preheated to working temperature generally between 1200° C. and 1300° C. We have determined that it is possible to successfully cast ferrous metals to produce a satisfactory strip product if these preheated components are brought together into their operative positions relative to the casting rollers and casting is commenced within such a short time interval that the preheated components, and particularly the delivery nozzle, do not develop significant localized cool spots which can lead to uneven solidification during casting. To this end, the illustrated caster has provisions whereby the preheated tundish and distribution nozzle can be rapidly fitted to the casting roller carriage when the carriage is at the assembly station 14, the carriage can then be moved with the preheated tundish and delivery nozzle to the casting station where the preheated side plates can be rapidly applied to the ends of the casting rollers immediately prior to pouring of molten metal from ladle 17.

Tundish 18 is preheated in a gas furnace 61 located adjacent the assembly station 14 and delivery nozzle 19 is preheated in a nozzle preheat furnace 62 also located adjacent assembly station 14. After preheating computer controlled robot devices denoted generally as 63, 64 mounted on an overhead rail 65 on machine frame 11 are operative firstly to move the preheated delivery nozzle from the preheat furnace and to mount it on the roller carriage and then to similarly move the tundish onto the roller carriage so as to be disposed accurately above the distribution nozzle.

Figure 3:
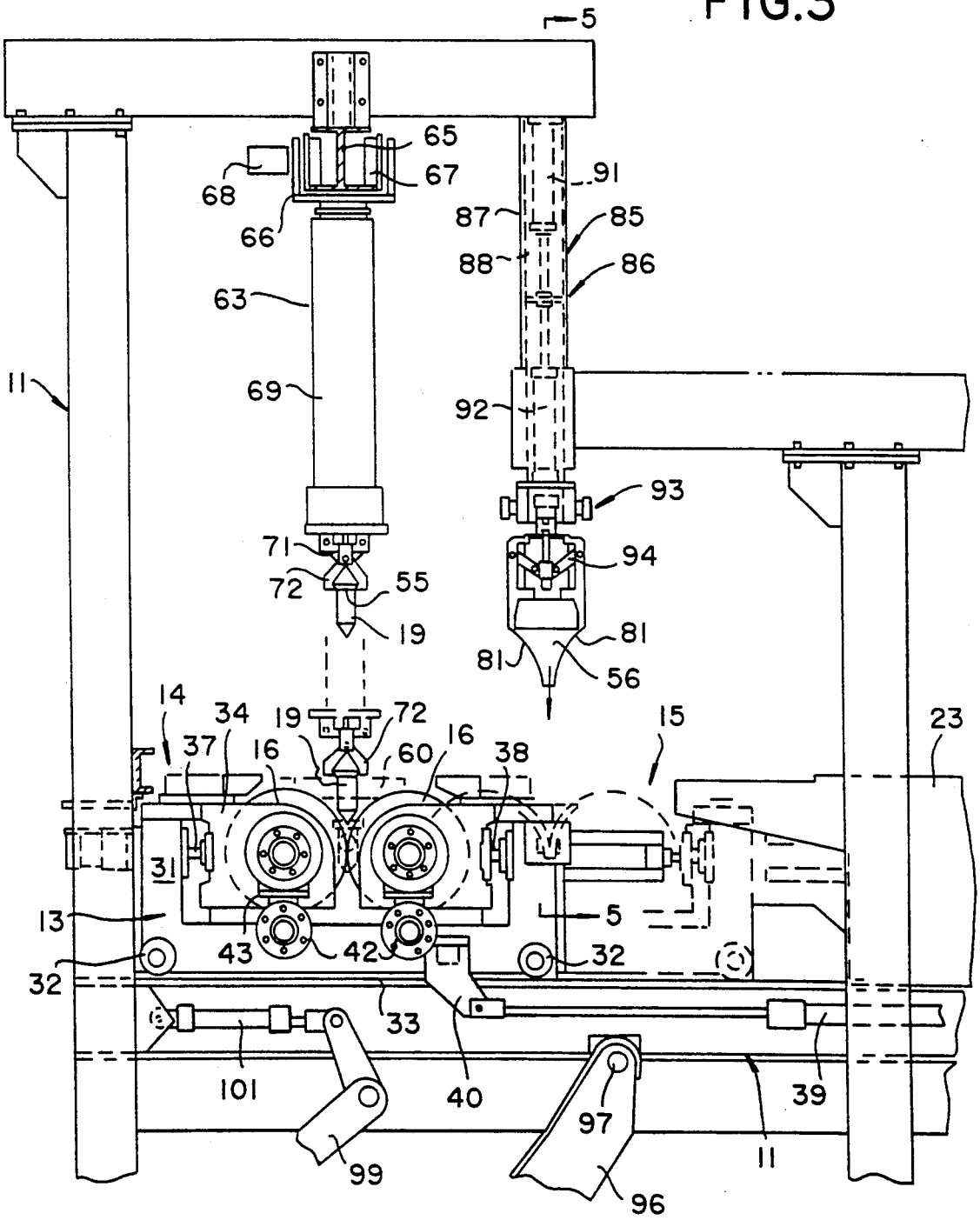
FIG. 3 is a vertical cross-section on the line 3—3 in FIG. 1.

The construction of robot device 63 and its operation to move the distribution nozzle 19 into position between the casting rollers is most clearly illustrated by FIGS. 1 and 3. As seen in those figures, overhead rail 65 extends transversely of the direction of movement of roller carriage 31 and it extends directly across the roller carriage above the nip between the rollers when the roller carriage is at assembly station 14. Device 63 comprises a carriage 66 mounted on rail 65 by wheels 67 and movable along the rail by operation of a drive motor 68 under computer control. Carriage 66 carries a downwardly depending pneumatic piston and cylinder unit 69 the lower end of which is fitted with a scissors mechanism 71 comprising inturned fingers 72 adapted to engage with the shoulders 55 at the upper end of the delivery nozzle 19.

Initially, device 63 is located above the delivery nozzle preheat furnace 62. After preheating cylinder unit 69 is extended to lower the scissors mechanism 71 which is actuated to engage the shoulders at the upper end of the delivery nozzle. Cylinder unit 69 is then retracted to lift the delivery nozzle out of the preheat furnace and carriage 66 is driven along overhead rail 65 to bring the delivery nozzle into a position disposed directly above the nip between the rollers 16 at the assembly station. Cylinder unit 69 is then actuated to lower the delivery nozzle into a position in which it seats in a mounting bracket 60 on the roller carriage frame 31 whereby it is supported in a position in which it projects downwardly into the nip between the casting rollers. The scissors mechanism 71 then releases and the cylinder unit 69 is retracted to lift it clear of the roller carriage. The whole device 63 is then moved away from the assembly station along overhead rail 65.

The construction of robot mechanism 64 and the manner in which it moves the tundish is most clearly illustrated in FIGS. 1 and 4. Device 64 comprises a carriage 77 mounted on overhead rail 65 by rollers 78 and movable along it by operation of a computer controlled drive motor 73. Carriage 77 carries a downwardly depending pneumatic piston and cylinder unit 74 the bottom of which is fitted with attachment devices 75 actuable releasably to attach to a lifting frame 76 fitted to the tundish.

Initially robot device 64 is located above the tundish as the tundish is being preheated in furnace 61 adjacent the assembly station 14. After preheating, cylinder unit 74 is extended and devices 75 actuated to engage with the tundish lifting frame 76. The cylinder unit 74 is then retracted to lift the tundish and carriage 77 is moved along rail 65 to bring the tundish into position above the roller carriage to which the preheated delivery nozzle has already been fitted. Cylinder unit 74 is then extended to lower the preheated tundish onto the roller carriage frame. The mounting brackets 53 at the bottom of the tundish support the tundish on the roller carriage frame and receive the indexing pegs 54 on the roller frame so as accurately to locate the tundish over the delivery nozzle. Devices 75 are then actuated to release the tundish frame and cylinder 74 is retracted to clear the carriage and tundish for movement from the assembly position to the casting position as indicated in FIG. 2.

Side closure plates 56 are made of a strong refractory material, for example boron nitride, and have scalloped side edges 81 to match the curvature of the stepped ends 57 of the rollers. The side plates can be mounted in plate holders 82 which are movable at the casting station by actuation of a pair of hydraulic cylinder units 83 to bring the side plates into engagement with the stepped ends of the casting rollers to form end closures for the molten pool of metal formed on the casting rollers during a casting operation.

Figure 5:
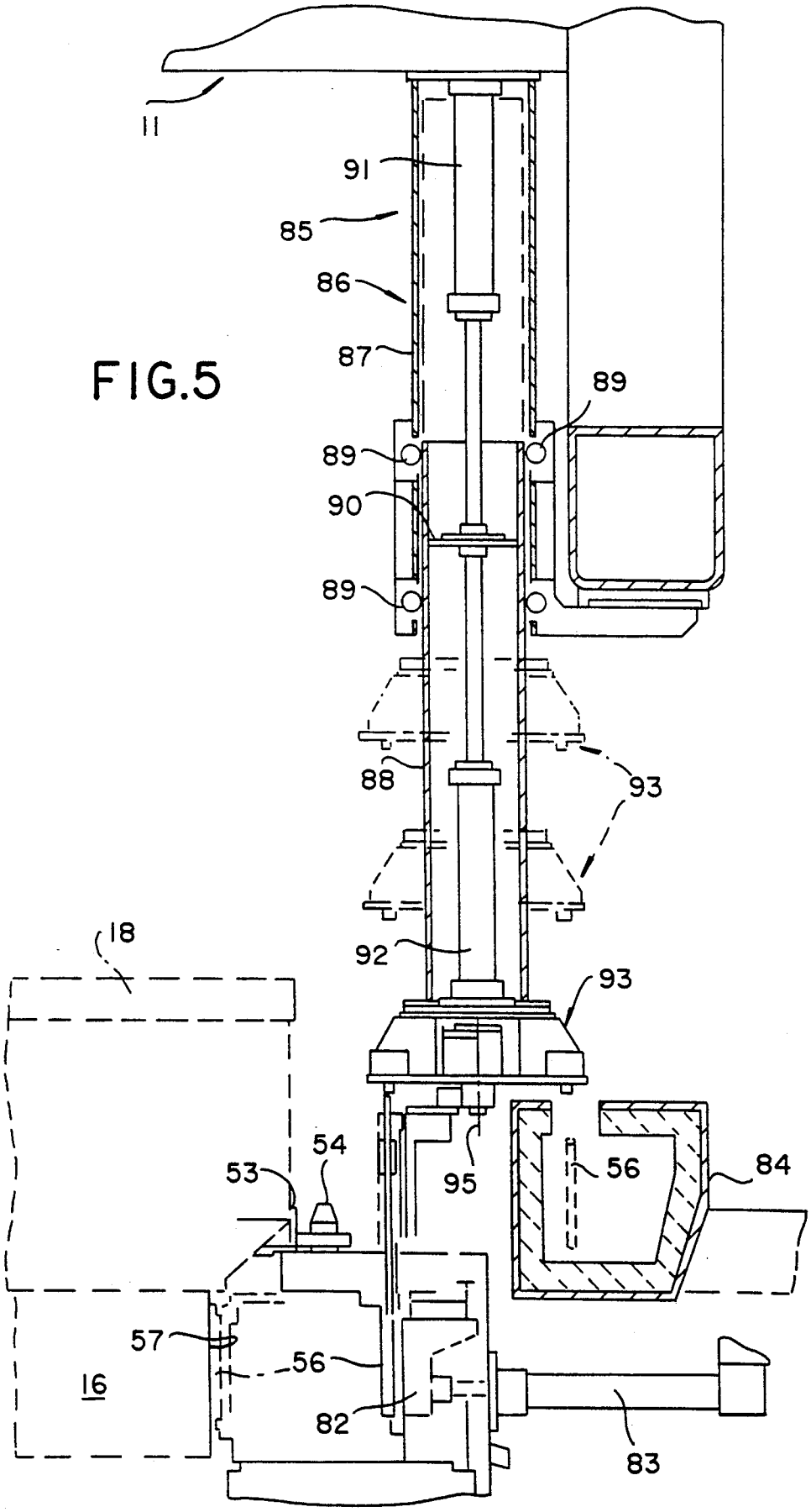
FIG. 5 is a vertical cross-section on the line 5—5 in FIG. 3 which particularly illustrates side plate positioning apparatus incorporated in the caster.
Figure 6:
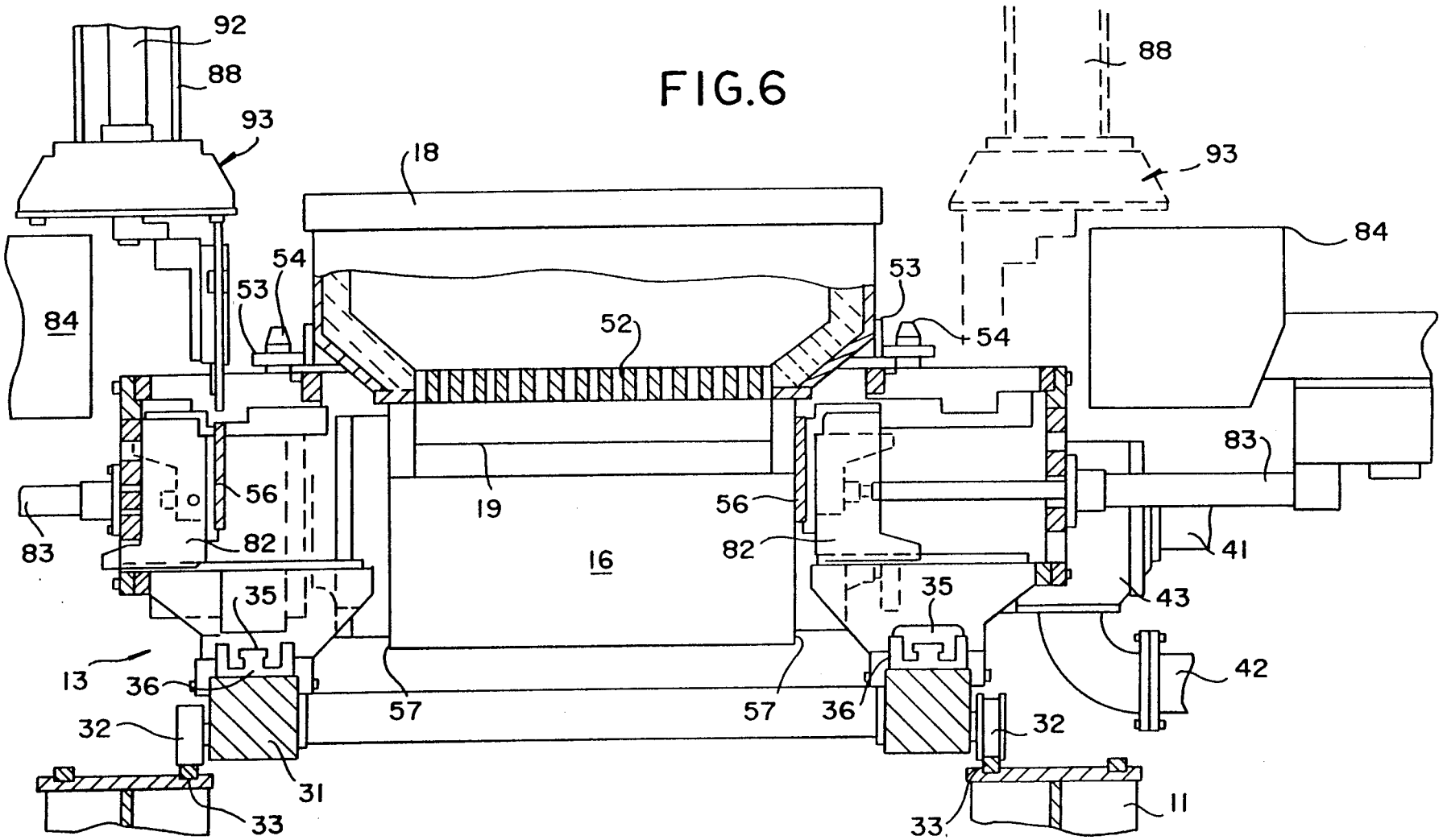
FIG. 6 is a vertical cross-section on the line 6—6 in FIG. 1.

Prior to the casting operation the side plates 56 are preheated in a pair of electric resistance heater furnaces 84 disposed one to each side of the casting station. After the preheating stage they are transferred from the furnaces 84 into the holders 86 by the operation of a pair of further robot devices denoted generally as 85. The construction of robot devices 85 and their operation to transfer the preheated side plates 56 from furnaces 84 into the side plate holders 82 is most clearly seen in FIGS. 1 and 5. Each device 85 comprises a vertical telescopic tubular structure 86 formed by an outer tube 87 fixed to machine frame 11 and an inner tube 88 which runs within the outer tube on rollers 89 and which can be raised and lowered by the operation of an internal double-acting extender formed by two pneumatic piston and cylinder units 91, 92, the pistons of which are joined and supported by a central slide 90.

The lower end of telescopic tube 88 carries a rotary head 93 which carries a pneumatically actuable clamp mechanism 94 and which is rotatable by operation of a pneumatic motor through 180° about a central vertical axis of rotation 95.

Devices 85 are disposed generally above and adjacent the two side plate preheat furnaces 84 and when the side plate holder actuator units 83 are in their retracted positions the side plate holders 82 are brought into positions below and adjacent furnaces 84. After the side plates have been preheated the telescopic tubular devices 86 are extended with the rotary heads 93 angularly positioned such that the clamping devices 94 can extend down into the furnaces 84 and can then be actuated to grip the preheated side plates. The telescopic devices 86 are then retracted to lift the side plates clear of the furnaces and the rotary heads 93 are rotated through 180° to move the side plates into positions directly above the side plate holders 82. The telescopic tubular devices 86 are then extended to lower the preheated side plates into the holders 82. The clamps 94 are then released and the telescopic devices 86 are fully retracted to lift devices 85 clear of the roller carriage. The side plate cylinder units 83 are then actuated to bring the preheated side plates into engagement with the stepped ends of the casting rollers. The side plates are biased against the rotating casting rollers by hydraulic cylinder units 83 throughout the casting operation.

Prior to a casting operation, the tundish and delivery nozzle are brought to a temperature of about 1200° to 1300° C. in the respective preheating facilities 61, 62 adjacent assembly station 14, the side plates are brought to a temperature of about 1250° C. in the side plate preheating furnaces 84 adjacent the casting station 15, the roller carriage is positioned at assembly station 14 and a hot ladle of steel is brought from the hot metal receiving station to the casting station. The following start up sequence of operations is then carried out:

1. The preheated delivery nozzle 19 is picked up by the appropriate robot device 63 and transported to the roller carriage and mounted on the roller carriage frame.

2. The preheated tundish 18 is picked up by the respective robot device 64 and put onto the roller carriage on which it is accurately positioned by the interengagement of the indexing pins 54 and the holes in the tundish mounting brackets.

3. The assembly of the roller carriage distribution nozzle and tundish is then moved along rails 34 to the casting station 15 by the operation of the hydraulic cylinder unit 39.

4. The preheated side plates 56 are lifted from preheat furnaces 84 by the robot device 85 and placed in side plate holders 82 and hydraulic cylinder units 83 are then actuated to bring the preheated side plates into engagement with the stepped ends 57 of the casting rollers.

5. The ladle stopper rod is actuated to allow molten metal to pour from the ladle to the tundish through the metal delivery nozzle whence it flows to the casting rollers.

6. The head end produced on initial pouring is guided by actuation of an apron table 96 to the jaws of coiler 21. Apron table 96 hangs from pivot mountings 97 on the main frame and can be swung toward the coiler by actuation of an hydraulic cylinder unit 98. Table 96 may operate against an upper strip guide flap 99 actuated by a piston and cylinder unit 101 and the strip may be confined between a pair of vertical side rollers 102. After the head end has been guided in to the jaws of the coiler, the coiler is rotated to coil the product and the apron table is allowed to swing back to its inoperative position where it simply hangs from the machine frame clear of the product which is taken directly onto coiler 21. The resulting strip product may be subsequently transferred to coiler 22 to produce a final coil for transport away from the caster.

In accordance with the present invention, delivery nozzle 19 is coated with a silicon based ceramic glaze which protects the nozzle against oxidation of the graphite during preheating and movement of the nozzle into position prior to casting. The glaze is applied over both the external and internal surfaces of the nozzle. When casting commences the coating on the inner surfaces will be abraded or consumed by the molten metal flowing through the nozzle so that the coating serves as a sacrificial coating which must be replaced after each casting operation. Oxidation of the graphite is not a problem after casting has commenced since the uncoated surfaces remain covered by molten metal which acts as an oxidation barrier.

The glaze can be applied by means of a circumferentially grooved applicator roller of a kind used in the production of coated steel products for painting with various coatings and provide a flow of coating material to a controlled thickness. Also in accordance with the present invention the side closure plates 56 are also be made of alumina graphite and coated with a silicon based ceramic glaze which protects the plate against oxidation of the graphite during preheating and application of the plates to the rollers prior to casting. When casting commences the coating on the inner surfaces of the plates may be abraded or consumed by the wearing action and the mechanical and chemical action of the molten metal so that the coating serves as a sacrificial coating which must be replaced after each casting operation. As in the case of the delivery nozzle, oxidation of the graphite is not a problem after casting has commenced since the uncoated surfaces remain covered by molten metal which acts as an oxidation barrier.

Figure 8:
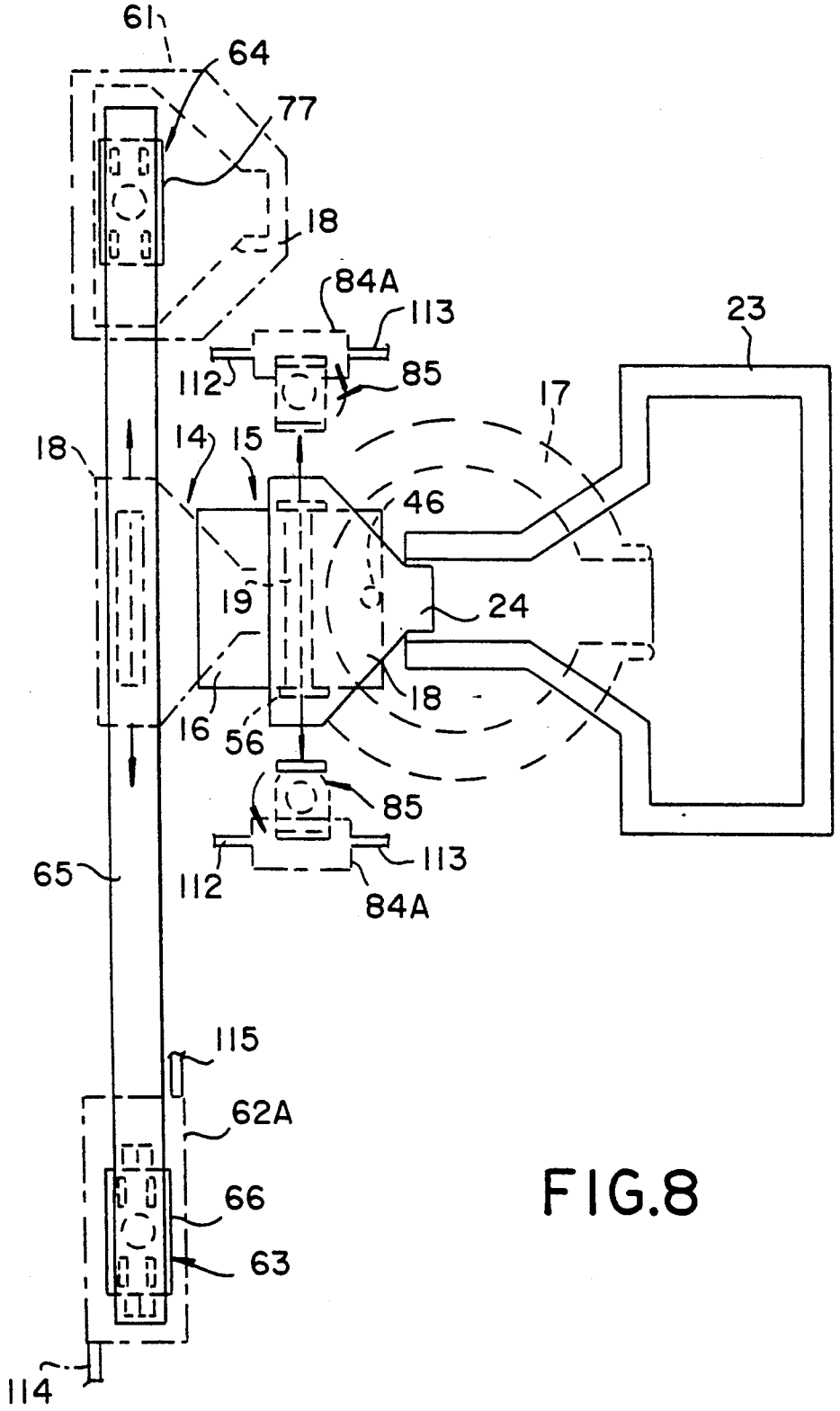
FIGS. 8 and 9 are views corresponding to FIGS. 1 and 5 but illustrating modifications which may be made to the apparatus for the purpose of preheating certain components in an inert atmosphere.
Figure 9:
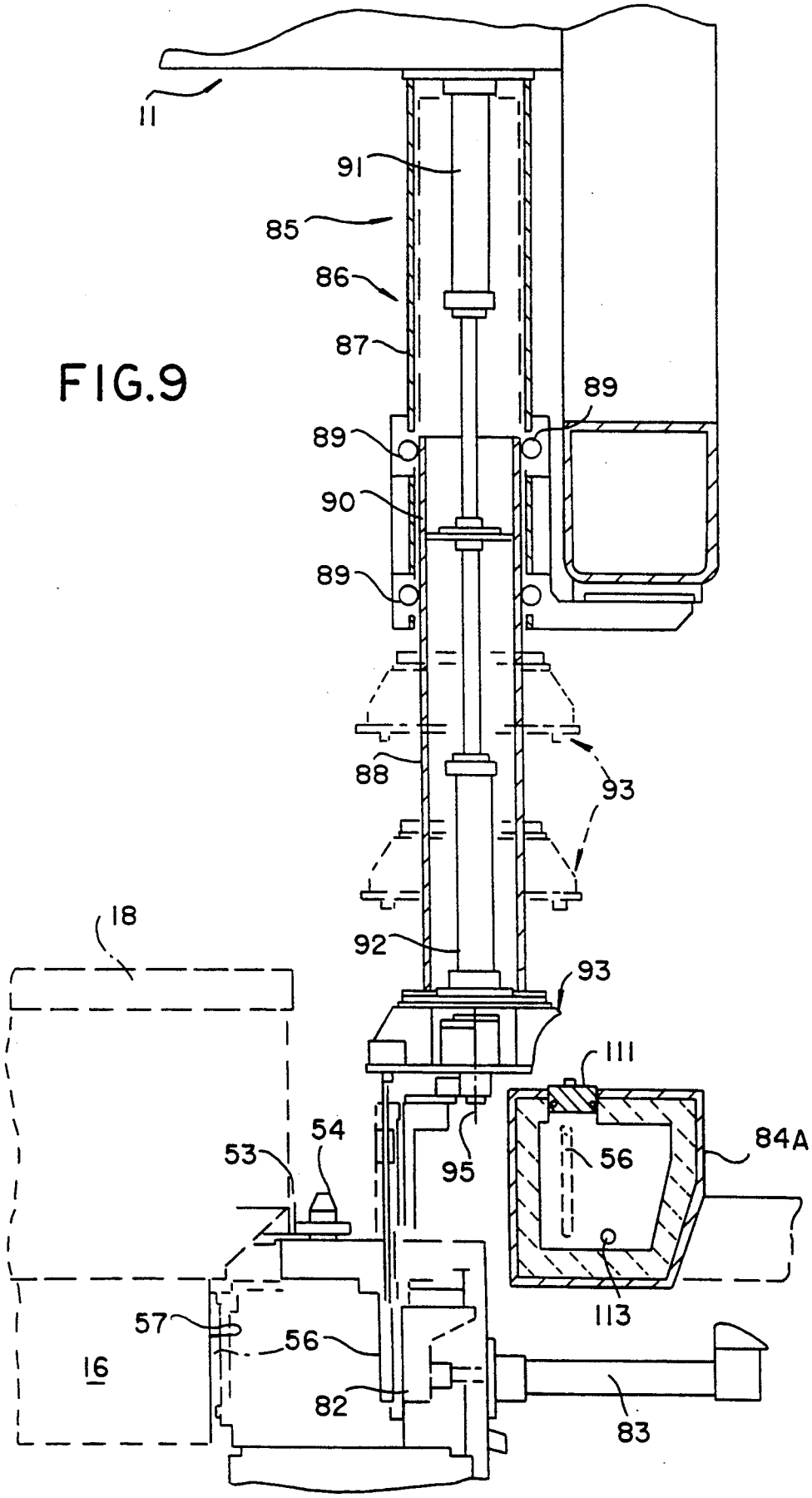

In an alternative procedure conducted in accordance with the invention, the nozzle may be preheated in a sealed furnace provided with argon pumping facilities to create an argon blanket around the nozzle during preheating. In this case the nozzle need not be provided with an oxidation retarding coating and may be made entirely of alumina graphite. Similarly, in accordance with the present invention, the side plate preheating furnaces may be constructed so as to produce sealed enclosures and provided with argon pumping facilities to create an argon blanket around each side plate during preheating. In that case the side plates need not be provided with an oxidation retarding coating and may be made entirely of alumina graphite. The alternative procedure of preheating the nozzle and the side plates in an inert atmosphere requires minor modifications to the casting equipment as illustrated in FIGS. 8 and 9. These figures correspond with FIGS. 1 and 5 and the unchanged components of the modified apparatus are identified by the same reference numerals as in the earlier figures.

In the modified, apparatus in accordance with FIGS. 8 and 9, the two side plate preheat furnaces are indicated as 84A. These furnaces are fitted with removable gas tight plugs 111 to seal the top openings of the furnaces and the furnaces are provided with gas inlet and outlet ducts 112, 113 through which to pump argon gas to create the argon blankets around the side plates during preheating. The top plugs 111 are simply removed from the preheat furnaces immediately prior to operation of the robot devices 85 to lift the side plates from the furnaces.

In the modified apparatus the nozzle preheat furnace is identified as 62A. This furnace is also provided with a gas tight plug to seal the top opening of the furnace during preheating and is provided with gas inlet and outlet ducts 114, 115 through which to pump argon to create an argon blanket around the nozzle during preheating. The gas tight top plugs are simply removed from the top of furnace 62A before the robot mechanism 63 is actuated to lift the preheated nozzle from the furnace.

We claim:

1. In the method of casting metal into a strip by:

feeding molten metal from refractory nozzle means into the nip of a pair of cooled rollers; confining said molten metal in said nip as a casting pool by providing refractory end closures at both sides of said nip; and passing said metal through said nip to cast a solid strip of metal; wherein prior to the commencement of said casting operation said nozzle means and said end closures are preheated to an elevated temperature which is sufficient to permit said metal to flow through said nip; and wherein said end closures are made of a material comprising a substantial proportion of graphite such that the surfaces thereof are oxidizable at the temperature of preheating; the improvement which comprises preheating the end closures at locations spaced from said rollers in enclosed preheat furnace means charged with inert gas; preheating each end closure in said inert atmosphere to inhibit surface oxidation thereof during preheating; and transferring said preheated end closures from said inert atmosphere in said preheat furnace means to their respective positions at the ends of the roller nip immediately prior to commencement of said casting operation.

2. The improved method as claimed in claim 1, wherein the inert gas is argon gas and wherein said method includes pumping said argon gas into said preheat furnace means to produce an argon blanket about each end closure during said preheating.

3. The improved process as claimed in claim 1, wherein each end closure is formed predominantly of alumina graphite.

4. The improved method as claimed in claim 1, wherein said refractory nozzle means comprises a material comprising a substantial proportion of graphite, such that surfaces thereof are oxidizable at the temperature of preheating, and wherein said method includes preheating said refractory nozzle means at a location spaced from the rollers in an enclosed nozzle preheat furnace means which is charged with an inert gas; preheating said refractory nozzle means in said inert gas atmosphere to inhibit surface oxidation thereof during said preheating; and transferring said preheated refractory nozzle means from said inert gas atmosphere in said nozzle preheat furnace means to its operative position above the roller nip immediately prior to commencement of said casting operation.

5. The improved process as claimed in claim 4, wherein said refractory nozzle means is formed predominantly of alumina graphite.

6. The improved process as claimed in claim 1, including covering said refractory nozzle means by a ceramic glaze sufficient to protect the surface of said nozzle against oxidation during said preheating; and consuming the glaze on that part of the surface of said refractory nozzle means which becomes covered by molten metal during said casting operation by said molten metal.

7. The improved process as claimed in claim 6, wherein said ceramic glaze is capable of protecting the surface of said refractory nozzle means against oxidation at temperatures in excess of 1200° C.

8. In the method of casting metal into a strip by:

feeding molten metal from refractory nozzle means into the nip of a pair of cooled rollers; confining said molten metal in said nip as a casting pool by providing refractory end closures at both sides of the nip; and passing said metal through said nip to cast a solid strip of metal; wherein prior to the commencement of said casting operation, said nozzle means and said end closures are preheated to an elevated temperature which is sufficient to permit said metal to flow through said nip; and wherein said nozzle means and said end closures are each made of alumina graphite such that the surfaces thereof are each made of alumina graphite such that the surfaces thereof are oxidizable at the temperature of preheating; the improvement which comprises: preheating the end closures at locations spaced from the rollers in enclosed furnace means charged with an inert gas so that each end closure is preheated in an inert atmosphere to inhibit surface oxidation thereof during said preheating; transferring said preheated end closures from said inert gas atmospheres in said preheat furnace means to their respective positions at the ends of the roller nip immediately prior to commencement of said casting operation; preheating said refractory nozzle means in a nozzle preheat furnace at a location spaced from the rollers; and transferring said refractory nozzle means from said furnace means to its operative position above the roller nip immediately prior to commencement of the casting operation; wherein said refractory nozzle means is covered by a ceramic glaze which protects the surface of said nozzle against oxidation during said preheating; and wherein said glaze on that part of the surface which becomes covered by molten metal during the casting operation is then consumed by the molten metal during said casting operation.

9. In the method of casting metal into a strip by:

feeding molten metal from refractory nozzle means into the nip of a pair of cooled rollers; confining said molten metal in said nip as a casting pool by providing refractory end closures, having surfaces which are oxidizable, at both sides of said nip; and passing said metal through said nip to cast a solid strip of metal; wherein prior to the commencement of said casting operation said nozzle means and said end closures are preheated to an elevated temperature which is sufficient to permit said metal to flow through said nip; the improvement which comprises: disposing said end closures at a location remote from said rollers; blanketing said end closures at a locations remote from said rollers; blanketing said end closures at said remote location with inert gas; preheating said end closures in said inert gas blanket under conditions, including said inert gas blanket, which inhibit surface oxidation thereof during said preheating; and transferring said preheated, subsfantially non-oxidized, end closures from said remote location to their respective positions at the ends of said roller nip prior to commencement of said casting operation.

* * * * *

UNITED STATES PATENT AND TRADEMARK OFFICE

CERTIFICATE OF CORRECTION

PATENT NO. : 5,259,439

DATED : November 9, 1993

INVENTOR(S) : Walter BLEJDE et al

It is certified that error appears in the above-identified patent and that said Letters Patent is hereby corrected as shown below:

On the title page, in Item [73], after "Lysaght" insert -- (Australia) Limited --; and Item [63], delete "Apr. 1, 1991" and substitute therefor -- Apr. 4, 1991 --.

Column 2, line 52, delete "in FIG. 1;"; and between lines 52 and 53, insert the following:

-- FIG. 2 is a vertical cross-section on the line 2-2 in FIG. 1; --.

Signed and Sealed this

Twelfth Day of July, 1994

*Attest:*

*Attesting Officer*

BRUCE LEHMAN

*Commissioner of Patents and Trademarks*